US008368681B2

(12) United States Patent
Yamashita et al.

(10) Patent No.: US 8,368,681 B2
(45) Date of Patent: Feb. 5, 2013

(54) IMAGE DISPLAY APPARATUS AND METHOD OF DRIVING THE IMAGE DISPLAY APPARATUS

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 566 days.

(21) Appl. No.: 12/585,982

(22) Filed: Sep. 30, 2009

(65) Prior Publication Data

US 2010/0103156 A1 Apr. 29, 2010

(30) Foreign Application Priority Data

Oct. 29, 2008 (JP) ..... 2008-277898

(51) Int. Cl.
*G09G 5/00* (2006.01)
*G09G 3/30* (2006.01)

(52) U.S. Cl. ..... 345/211; 345/76

(58) Field of Classification Search ..... 345/76–77, 345/82, 89, 211, 55, 213; 315/169.3
See application file for complete search history.

(56) References Cited

U.S. PATENT DOCUMENTS

2007/0268210 A1 11/2007 Uchino et al.
2008/0030436 A1* 2/2008 Iida et al. ..... 345/77

FOREIGN PATENT DOCUMENTS

| | | | |
|---|---|---|---|
| JP | 2006-030729 | A | 2/2006 |
| JP | 2007-133284 | | 5/2007 |
| JP | 2007-310311 | | 11/2007 |
| JP | 2007-316454 | A | 12/2007 |
| JP | 2008-145646 | A | 6/2008 |
| JP | 2008-203478 | A | 9/2008 |
| JP | 2008-233122 | A | 10/2008 |
| JP | 2008-241948 | A | 10/2008 |
| JP | 2008-242205 | A | 10/2008 |

OTHER PUBLICATIONS

Japanese Office Action issued Dec. 14, 2010 for corresponding Japanese Application No. 2008-277898.

* cited by examiner

*Primary Examiner* — Hoa T Nguyen
*Assistant Examiner* — Andrew Sasinowski
(74) *Attorney, Agent, or Firm* — Rader, Fishman & Grauer PLLC

(57) ABSTRACT

The present invention sets a scanning line to which a driving signal for power supply is output to a floating state in an entire period of pauses of threshold voltage correction processing or a partial period thereof.

4 Claims, 10 Drawing Sheets

IMAGE DISPLAY APPARATUS AND METHOD OF DRIVING THE IMAGE DISPLAY APPARATUS

BACKGROUND OF THE INVENTION

1. Field of the Invention

The present invention relates to an image display apparatus and a driving method of the image display apparatus and can be applied to, for example, an active matrix image display apparatus using organic EL (Electro Luminescence) devices. According to the present invention, when fluctuations in threshold voltage of a driving transistor are corrected by setting a scanning line to output a driving signal for power supply to a floating state to discharge an inter-terminal voltage of holding capacity in a plurality of periods via the driving transistor in the entire period or a partial period of pauses of threshold voltage correction processing, fluctuations in threshold voltage of the driving transistor can reliably be corrected.

2. Description of the Related Art

In recent years, active matrix image display apparatuses using organic EL devices have actively been developed. Here, an organic EL device can be driven with an applied voltage of 10 [V] or less. Thus, this type of image display apparatus can reduce power consumption. Moreover, an organic EL device is a self-luminous device. Therefore, this type of image display apparatus does not need a backlight apparatus so that the image display apparatus can be made lighter and thinner. Further, the organic EL device is characterized by a quick response speed of about several μsec. Therefore, this type of image display apparatus is characterized in that an afterimage rarely persists during display of moving images.

More specifically, in an active matrix image display apparatus using organic EL devices, pixel circuits including organic EL devices and driving circuits driving organic EL devices are arranged in a matrix form to form a display unit. This type of image display apparatus displays a desired image by driving each pixel circuit by a signal line driving circuit and a scanning line driving circuit arranged around the perimeter of the display unit via a signal line and a scanning line, respectively, provided in the display unit.

As to an image display apparatus using the organic EL device, Japanese Patent Application Laid-Open No. 2007-310311 discloses a configuration in which two transistors are used to form a pixel circuit to prevent fluctuations in threshold voltage of driving transistors that drive the organic EL device and quality deterioration due to fluctuations in mobility.

Here, FIG. 8 is a block diagram showing an image display apparatus disclosed by Japanese Patent Application Laid-Open No. 2007-310311. This image display apparatus 1 is an image display apparatus using organic EL devices and a display unit 2 is created on an insulating substrate such as glass. The image display apparatus 1 has a signal line driving circuit 3 and a scanning line driving circuit 4 created around the perimeter of the display unit 2.

Here, the signal line driving circuit 3 outputs a driving signal Ssig for signal line to a signal line DTL provided in the display unit 2. More specifically, after image data D1 input in order of raster scanning is latched sequentially and distributed to the signal line DTL by a horizontal selector (HSEL) 3A, the signal line driving circuit 3 performs digital/analog conversion processing on each image data D1. The signal line driving circuit 3 processes a digital/analog conversion result to generate the driving signal Ssig. The image display apparatus 1 thereby sets a gradation of each pixel circuit 5 in accordance with, for example, a so-called line sequence.

The scanning line driving circuit 4 outputs a write signal WS and a driving signal DS to a scanning line WSL for write signal and a scanning line DSL for power supply provided in the display unit 2, respectively. Here, the write signal WS is a signal to exercise ON/OFF control of a write transistor provided in each pixel circuit 5. The driving signal DS is a signal to control the drain voltage of a driving transistor provided in each pixel circuit 5. The scanning line driving circuit 4 processes predetermined sampling pulses SP at a clock CK in a write scan circuit (WSCN) 4A and a drive scan circuit (DSCN) 4B to output the write signal WS and the driving signal DS, respectively.

The display unit 2 is formed by arranging the pixel circuits 5 in a matrix form. The display unit 2 has color filters of red, green and blue provided sequentially cyclically in each pixel circuit 5 and accordingly, pixels of red, green, and blue are sequentially created.

Here, in the pixel circuit 5, the cathode of an organic EL device 8 is connected to a predetermined power supply Vcath and the anode of the organic EL device 8 is connected to the source of a driving transistor Tr2. The driving transistor Tr2 is, for example, an N-channel type transistor of TFT. In the pixel circuit 5, the drain of the driving transistor Tr2 is connected to the scanning line DSL for power supply and the driving signal DS for power supply is supplied to the scanning line DSL from the scanning line driving circuit 4. Accordingly, the pixel circuit 5 drives by current the organic EL device 8 using the driving transistor Tr2 in a source follower circuit configuration.

The pixel circuit 5 has a holding capacity Cs provided between the gate and source of the driving transistor Tr2 and a gate-side voltage of the holding capacity Cs is set to the voltage of the driving signal Ssig by the write signal WS. As a result, the pixel circuit 5 drives by current the organic EL device 8 using the driving transistor Tr2 by a gate-source voltage Vgs in accordance with the driving signal Ssig. Here, in FIG. 8, a capacity Cel is a stray capacitance of the organic EL device 8. It is assumed below that the capacity Cel is sufficiently larger than the holding capacity Cs and the parasitic capacitance of the gate node of the driving transistor Tr2 is sufficiently smaller than the holding capacity Cs.

That is, in the pixel circuit 5, the gate of the driving transistor Tr2 is connected to the signal line DTL via a write transistor Tr1 switched ON/OFF by the write signal WS. Here, the write transistor Tr1 is, for example, an N-channel type transistor of TFT.

Here, the signal line driving circuit 3 outputs the driving signal Ssig by alternately repeating a gradation setting voltage Vsig and a voltage Vofs for threshold voltage correction. The fixed voltage Vofs for threshold voltage correction is a fixed voltage used for correcting fluctuation of the threshold voltage of the driving transistor Tr2. The gradation setting voltage Vsig is a voltage specifying the luminance of emission of the organic EL device 8 and is obtained by adding the fixed voltage Vofs for threshold voltage correction to a gradation voltage Vin. The gradation voltage Vin is a voltage corresponding to the luminance of emission of the organic EL device 8. The gradation voltage Vin is generated for each signal line DTL by, after the image data D1 input in order of raster scanning is latched sequentially and distributed to each signal line DTL by the horizontal selector 3A, performing digital/analog conversion processing on the image data D1.

As shown in FIG. 9, in the pixel circuit 5, the write transistor Tr1 is set to an OFF state by the write signal WS in a period of emission during which the organic EL device 8 is caused to emit light (FIG. 9A). In the pixel circuit 5, a power supply voltage Vcc is supplied to the driving transistor Tr2 by the driving signal DS for power supply in the period of emission (FIG. 9B). Accordingly, the pixel circuit 5 drives by current the organic EL device 8 by a driving current in accordance with an inter-terminal voltage of the holding capacity Cs to cause light emission in the period of emission.

In the pixel circuit 5, the driving signal DS for power supply is caused to fall to a predetermined fixed voltage Vss2 at time t0 when the period of emission ends (FIG. 9B). Here, the fixed voltage Vss2 is sufficiently low so that the drain of the driving transistor Tr2 can be caused to function as a source and is a voltage lower than the cathode voltage Vcath of the organic EL device 8.

Accordingly, in the pixel circuit 5, accumulated charges on the anode side of the organic EL device 8 flow out to the scanning line DSL via the driving transistor Tr2. As a result, in the pixel circuit 5, a source voltage Vs of the driving transistor Tr2 falls to the voltage Vss2 (FIG. 9E) and the organic EL device 8 stops emitting light. Also in the pixel circuit 5, a gate voltage Vg of the driving transistor Tr2 falls by operating together with the fall of the source voltage Vs (FIG. 9D).

In the pixel circuit 5, at a subsequent predetermined time t1, the write transistor Tr1 is changed to an ON state by the write signal WS (FIG. 9A) and the gate voltage Vg of the driving transistor Tr2 is set to the fixed voltage Vofs for threshold voltage correction set to the signal line DTL (FIGS. 9C and 9D). Accordingly, in the pixel circuit 5, the gate-source voltage Vgs of the driving transistor Tr2 is set to a voltage Vofs-Vss2. Here, in the pixel circuit 5, the voltage Vofs-Vss2 is set higher than a threshold voltage Vth of the driving transistor Tr2 based on settings of the voltages Vofs and Vss2.

Then, in the pixel circuit 5, at time t2, the drain voltage of the driving transistor Tr2 is caused to rise to the power supply voltage Vcc by the driving signal DS (FIG. 9B). Accordingly, in the pixel circuit 5, a charging current flows into the organic EL device 8 of the holding capacity Cs from the power supply Vcc via the driving transistor Tr2. As a result, in the pixel circuit 5, the voltage Vs on the side of the organic EL device 8 of the holding capacity Cs gradually rises. In this case, the current flowing into the organic EL device 8 via the driving transistor Tr2 is used only for charging of the capacity Cel and the holding capacity Cs of the organic EL device 8. As a result, in the pixel circuit 5, only the source voltage Vs of the driving transistor Tr2 rises without the organic EL device 8 being caused to emit light.

Here, in the pixel circuit 5, when the inter-terminal voltage of the holding capacity Cs becomes equal to the threshold voltage Vth of the driving transistor Tr2, the inflow of the charging current via the driving transistor Tr2 stops. Therefore, in this case, the rise of the source voltage Vs of the driving transistor Tr2 stops when the potential difference between terminals of the holding capacity Cs becomes equal to the threshold voltage Vth of the driving transistor Tr2. Accordingly, the pixel circuit 5 causes the inter-terminal voltage of the holding capacity Cs to discharge via the driving transistor Tr2 to set the inter-terminal voltage of the holding capacity Cs to the threshold voltage Vth of the driving transistor Tr2.

In the pixel circuit 5, at time t3 after passage of sufficient time to set the inter-terminal voltage of the holding capacity Cs to the threshold voltage Vth of the driving transistor Tr2, the write transistor Tr1 is switched to an OFF state by the write signal WS (FIG. 9A). Subsequently, the voltage of the signal line DTL is set to the gradation setting voltage Vsig (=Vin+Vofs).

In the pixel circuit 5, at a subsequent time t4, the write transistor Tr1 is set to an ON state (FIG. 9A). Accordingly, in the pixel circuit 5, the gate voltage Vg of the driving transistor Tr2 is set to the gradation setting voltage Vsig and the gate-source voltage Vgs of the driving transistor Tr2 to a voltage obtained by adding the threshold voltage Vth of the driving transistor Tr2 to the gradation voltage Vin. Accordingly, the pixel circuit 5 can drive the organic EL device 8 by effectively avoiding fluctuations in the threshold voltage Vth of the driving transistor Tr2 so that quality deterioration due to fluctuations in luminance of emission of the organic EL device 8 can be prevented.

When the gate voltage Vg of the driving transistor Tr2 is set to the gradation setting voltage Vsig in the pixel circuit 5, the gate of the driving transistor Tr2 is connected to the signal line DTL for a fixed period Tμ while retaining the drain voltage of the driving transistor Tr2 at the power supply voltage Vcc. Accordingly, in the pixel circuit 5, fluctuations in mobility μ of the driving transistor Tr2 is also corrected.

That is, if the gate of the driving transistor Tr2 is connected to the signal line DTL by setting the write transistor Tr1 to an ON state while the inter-terminal voltage of the holding capacity Cs is set to the threshold voltage Vth of the driving transistor Tr2, the gate voltage Vg of the driving transistor Tr2 is set to the gradation setting voltage Vsig after gradually rising from the fixed voltage Vofs.

Here, in the pixel circuit 5, the write time constant necessary for the rise of the gate voltage Vg of the driving transistor Tr2 is set such that the write time constant becomes short as compared with the time constant necessary for the rise of the source voltage Vs by the driving transistor Tr2.

In this case, when the write transistor Tr1 is turned on, the gate voltage Vg of the driving transistor Tr2 will swiftly rise to the gradation setting voltage Vsig (Vofs+Vin). If the capacity Cel of the organic EL device 8 is sufficiently larger than the holding capacity Cs during the rise of the gate voltage Vg, the source voltage Vs of the driving transistor Tr2 will not fluctuate.

However, if the gate-source voltage Vgs of the driving transistor Tr2 increases over the threshold voltage Vth, a current flows in from the power supply Vcc via the driving transistor Tr2 so that the source voltage Vs of the driving transistor Tr2 gradually rises. As a result, in the pixel circuit 5, the inter-terminal voltage of the holding capacity Cs discharges through the driving transistor Tr2, lowering the rise speed of the gate-source voltage Vgs.

The discharging speed of the inter-terminal voltage changes depending on performance of the driving transistor Tr2. More specifically, the discharging speed increases with the increasing mobility μ of the driving transistor Tr2.

As a result, the pixel circuit 5 is set so that the inter-terminal voltage of the holding capacity Cs decreases with the increasing mobility μ of the driving transistor Tr2 to correct fluctuations in luminance of emission caused by fluctuations in mobility. In FIG. 9, the fall of the inter-terminal voltage according to corrections of the mobility μ is denoted by ΔV.

In the pixel circuit 5, when the correction period Tμ of mobility passes, the write signal WS is caused to fall at time t5. As a result, the pixel circuit 5 starts the period of emission and causes the organic EL device 8 to emit light by a driving current in accordance with the inter-terminal voltage of the holding capacity Cs. When the period of emission starts, the gate voltage Vg and the source voltage Vs of the driving transistor Tr2 rises due to a so-called bootstrap circuit in the pixel circuit 5.

With these operations, the pixel circuit 5 performs preparation processing of threshold voltage correction processing of the driving transistor Tr2 in the period between time t0 and time 2 in which the gate voltage of the driving transistor Tr2 is caused to fall to the voltage Vss2. In the subsequent period between time t2 and time t3 denoted by reference numeral Tth, the threshold voltage correction processing of the driving transistor Tr2 is performed by setting the inter-terminal voltage of the holding capacity Cs to the threshold voltage Vth of the driving transistor Tr2. In the period Tμ between time t4 and time t5, the mobility of the driving transistor Tr2 is corrected and also processing to sample the gradation setting voltage Vsig is performed.

Thus, in the configuration in FIG. 8, the image display apparatus 1 sets the period of emission and the period of non-emission in which the organic EL device 8 is not caused to emit light by the driving signal DS for power supply. Therefore, the drive scan circuit 4B (FIG. 8) correspondingly outputs the drive signal DS by complementary ON/OFF control of a P-channel type transistor Tr3 and an N-channel type transistor Tr4 whose drain is connected to the predetermined voltages Vcc and Vss2. In FIG. 8, reference numeral 9 is an inverter that inputs a gate signal of the transistor Tr4 into the gate of the transistor Tr3 by inverting the gate signal.

For this type of image display apparatus, Japanese Patent Application Laid-Open No. 2007-133284 proposes a configuration in which processing to correct fluctuations in threshold voltage is performed by dividing the period Tth into a plurality of periods.

SUMMARY OF THE INVENTION

Incidentally, the pixel circuit 5 shown in FIG. 8 corrects fluctuations in the threshold voltage Vth of the driving transistor Tr2 by setting the inter-terminal voltage of the holding capacity Cs to the threshold voltage Vth of the driving transistor Tr2 before setting the gradation setting voltage Vsig. Processing to set the inter-terminal voltage of the holding capacity Cs to the threshold voltage Vth of the driving transistor Tr2 is performed in the period Tth between time t2 and time t3 by discharging the inter-terminal voltage of the holding capacity Cs via the driving transistor Tr2.

Thus, as the period Tth between time t2 and time t3 that can be allocated to pixels in one line becomes shorter with, for example, higher resolutions and higher frequencies, it becomes more difficult for the pixel circuit 5 to correctly set the inter-terminal voltage of the holding capacity Cs to the threshold voltage Vth of the driving transistor Tr2. As a result, the pixel circuit 5 may not be able to sufficiently correct quality deterioration due to fluctuations in the threshold voltage Vth of the driving transistor Tr2.

Thus, in this case, an insufficient time may be supplemented by applying the technique disclosed in Japanese Patent Application Laid-Open No. 2007-133284, namely, by performing processing to set the inter-terminal voltage of the holding capacity Cs to the threshold voltage Vth of the driving transistor Tr2 in a plurality of periods.

That is, FIG. 10 is a time chart showing an operation of the pixel circuit 5 when the technique disclosed in Japanese Patent Application Laid-Open No. 2007-133284 is applied to the image display apparatus described above with reference to FIG. 8 by being contrasted with FIG. 9. In FIG. 10, a period in which preparation processing of threshold voltage correction of the driving transistor Tr2 is performed is denoted by reference numeral TP. Fluctuation correction processing of the threshold voltage of the driving transistor Tr2 is performed in three periods of Tth1, Tth2, and Tth3 in FIG. 10.

That is, in the example in FIG. 10, the inter-terminal voltage of the holding capacity Cs is set to a voltage equal to or higher than the threshold voltage Vth of the driving transistor Tr2 using the fixed voltage Vofs for threshold voltage correction with three lines preceding (FIGS. 10A to 10E). Then, the write signal WS is set to an ON state in the period Tth1 during which the voltage of the signal line DTL is set to the fixed voltage Vofs to cause the inter-terminal voltage of the holding capacity Cs to discharge via the driving transistor Tr2 (FIGS. 10A to 10E). In a subsequent period T1, the write transistor Tr1 is set to an OFF state by the write signal WS to temporarily stop the discharge of the inter-terminal voltage of the holding capacity Cs.

Subsequently, in the period Tth2 during which the voltage of the signal line DTL is set to the fixed voltage Vofs, the write transistor Tr1 is set to an ON state to cause the inter-terminal voltage of the holding capacity Cs to discharge via the driving transistor Tr2. Subsequently, the write transistor Tr1 is set to an OFF state by the write signal WS to temporarily stop the discharge of the inter-terminal voltage of the holding capacity Cs.

Subsequently, in the period Tth3 during which the voltage of the signal line DTL is set to the fixed voltage Vofs, the write transistor Tr1 is set to an ON state to cause the inter-terminal voltage of the holding capacity Cs to discharge via the driving transistor Tr2. Thus, in the example in FIG. 10, processing to set the inter-terminal voltage of the holding capacity Cs to the threshold voltage Vth of the driving transistor Tr2 by a discharge via the driving transistor Tr2 is performed in the three periods of Tth1, Tth2, and Tth3. The periods T1 and T2 during which processing to discharge the inter-terminal voltage of the holding capacity Cs via the driving transistor Tr2 is temporarily stopped will be called a pause of the threshold voltage correction processing below.

In the example in FIG. 10, the inter-terminal voltage of the holding capacity Cs can be caused to discharge via the driving transistor Tr2 by securing a sufficient time even with ever higher resolutions and frequencies. Therefore, the inter-terminal voltage of the holding capacity Cs can correctly be set to the threshold voltage Vth of the driving transistor Tr2.

However, with the configuration in FIG. 10, a charging current flows to the source side of the holding capacity Cs via the driving transistor Tr2 in the pauses T1 and T2. As a result, in the pixel circuit 5, the source voltage Vs of the driving transistor Tr2 will gradually rise in the pauses T1 and T2. Also in the pixel circuit 5, the gate voltage Vg of the driving transistor Tr2 will gradually rise in association with the rise of the source voltage.

Here, if the inter-terminal voltage of the holding capacity Cs is adequately close to the threshold voltage Vth of the driving transistor Tr2 when the pause T1 or T2 starts, the rise of the gate voltage Vg and that of the source voltage Vs in the pause T1 or T2 can be ignored.

However, if the inter-terminal voltage of the holding capacity Cs is not adequately close to the threshold voltage Vth of the driving transistor Tr2 when the pause T1 or T2 starts, it is difficult to ignore the rise of the gate voltage Vg and that of the source voltage Vs in the pause T1 or T2. As a result, if the gate voltage Vg of the driving transistor Tr2 is set to the fixed voltage Vofs by turning on the write transistor Tr1 by the write signal WS when the pause T1 or T2 ends, there is a possibility that the inter-terminal voltage of the holding capacity Cs falls below the threshold voltage Vth of the driving transistor Tr2. In such a case, the pixel circuit 5 has a problem that fluctuations in the threshold voltage Vth of the driving transistor Tr2 may not be corrected. That is, in such a case, processing to correct fluctuations in the threshold voltage of the driving transistor Tr2 will fail. Therefore, in such a case, it is difficult to correctly correct fluctuations in the threshold voltage of the driving transistor Tr2, leading to image quality deterioration.

The present invention has been made in view of the above problem and proposes an image display apparatus capable of reliably correcting fluctuations in threshold voltage of a driving transistor even if fluctuations in threshold voltage of the driving transistor are corrected by discharging an inter-terminal voltage of holding capacity in a plurality of periods via the driving transistor and a method of driving the image display apparatus.

According to an embodiment of the present invention, there is provided an image display apparatus including a display unit in which pixel circuits are arranged in a matrix form, a signal line driving circuit that outputs a signal line driving signal to a signal line provided in the display unit, and a scanning line driving circuit that outputs at least a driving signal for power supply and a write signal to a scanning line provided in the display unit, wherein the pixel circuit includes at least a light-emitting device, a driving transistor, to a drain of which the driving signal for power supply is applied to drive by current the light-emitting device by a driving current in accordance with a gate-source voltage, a holding capacity that holds the gate-source voltage, and a write transistor that connects a gate of the driving transistor to the signal line by the write signal to set a terminal voltage of the holding capacity to a voltage of the signal line, and alternately repeats a period of emission during which the light-emitting device is caused to emit light and a period of non-emission during which light emission by the light-emitting device is stopped by output signals of the signal line driving circuit and the scanning line driving circuit, the pixel circuit, in the period of non-emission and after an inter-terminal voltage of the holding capacity is set to a voltage equal to or higher than a threshold voltage of the driving transistor, discharges the inter-terminal voltage of the holding capacity via the driving transistor in a plurality of periods sandwiching a pause therebetween to set the inter-terminal voltage of the holding capacity to the threshold voltage of the driving transistor and then, sets the terminal voltage of the holding capacity via the write transistor to set a gradation of the light-emitting device in a subsequent period of emission, and the scanning line driving circuit sets the scanning line, to which the driving signal for power supply is output, to a floating state in an entire period of the pauses or a partial period thereof.

According to an embodiment of the present invention, there is provided a method of driving an image display apparatus including a display unit in which pixel circuits are arranged in a matrix form, a signal line driving circuit that outputs a signal line driving signal to a signal line provided in the display unit, and a scanning line driving circuit that outputs at least a driving signal for power supply and a write signal to a scanning line provided in the display unit, wherein the pixel circuit includes at least a light-emitting device, a driving transistor, to a drain of which the driving signal for power supply is applied to drive by current the light-emitting device by a driving current in accordance with a gate-source voltage, a holding capacity that holds the gate-source voltage, and a write transistor that connects a gate of the driving transistor to the signal line by the write signal to set a terminal voltage of the holding capacity to a voltage of the signal line, and alternately repeats a period of emission during which the light-emitting device is caused to emit light and a period of non-emission during which light emission by the light-emitting device is stopped by output signals of the signal line driving circuit and the scanning line driving circuit, the driving method includes the steps of setting an inter-terminal voltage of the holding capacity to a voltage equal to or higher than a threshold voltage of the driving transistor in the period of non-emission, discharging the inter-terminal voltage of the holding capacity via the driving transistor in a plurality of periods sandwiching a pause therebetween to set the inter-terminal voltage of the holding capacity to the threshold voltage of the driving transistor in the period of non-emission, and setting the terminal voltage of the holding capacity via the write transistor to set a gradation of the light-emitting device in a subsequent period of emission in the period of non-emission, and the threshold voltage correction step includes the step of setting the scanning line to which the driving signal for power supply is output to a floating state in an entire period of the pauses or a partial period thereof.

According to the configuration of an embodiment of the present invention, image quality deterioration can be prevented in a period of non-emission by, after the inter-terminal voltage of holding capacity is set to a voltage equal to or higher than the threshold voltage of the driving transistor, setting the inter-terminal voltage of the holding capacity to the threshold voltage of the driving transistor by a discharge via the driving transistor and then, setting the terminal voltage of the holding capacity. The discharge of the inter-terminal voltage can be performed in a plurality of periods by discharging the inter-terminal voltage of the holding capacity via the driving transistor in the plurality of periods sandwiching a pause therebetween. Here, by setting the scanning line that outputs the driving signal for power supply to a floating state in the entire period or a partial period of pauses, the power supply is prevented from being supplied to the driving transistor in the entire period or a partial period thereof so that the rise of the source voltage of the driving transistor can be prevented. Therefore, in the entire period or a partial period thereof, the inter-terminal voltage of the holding capacity can be prevented from decreasing. Accordingly, even if correction of fluctuations in threshold voltage of the driving transistor is made by a discharge of the inter-terminal voltage of the holding capacity via the driving transistor in the plurality of periods, the inter-terminal voltage of the holding capacity can correctly be set to the threshold voltage of the driving transistor without causing the processing to fail so that deterioration of image quality can reliably be prevented.

According to the present invention, fluctuations in threshold voltage of a driving transistor can reliably be corrected even if fluctuations in threshold voltage of the driving transistor are corrected by discharging an inter-terminal voltage of holding capacity in a plurality of periods via the driving transistor.

DETAILED DESCRIPTION OF THE EMBODIMENTS

Figures 1A, 1B, 1C, 1D, 1E, 1F, 1G:
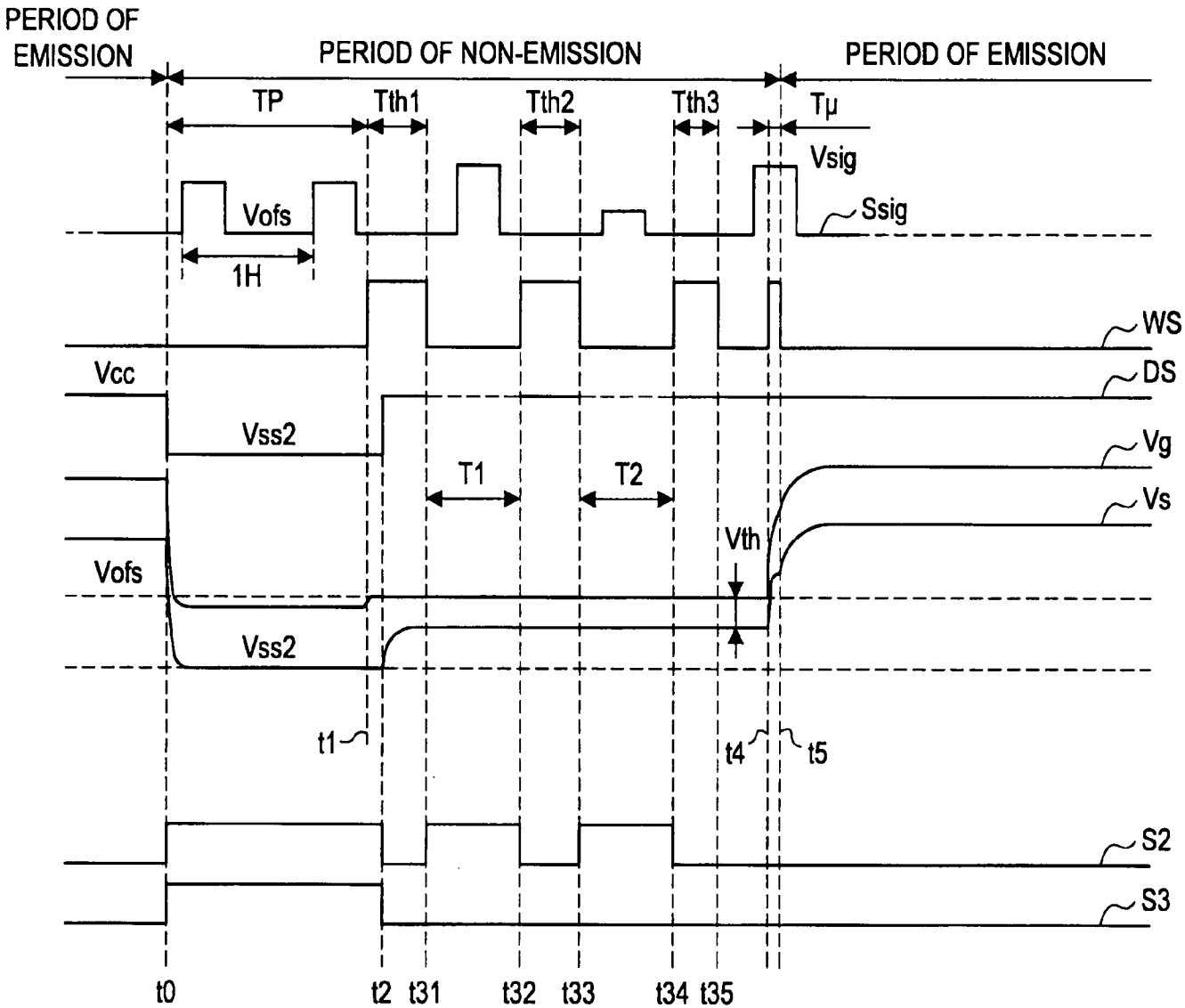
FIGS. 1A to 1G are time charts for explaining operations of an image display apparatus according to a first embodiment of the present invention.

Hereinafter, preferred embodiments of the present invention will be described in detail with reference to the appended drawings. Note that, in the specification and the appended drawings, structural elements that have substantially the same function and structure are denoted with the same reference numerals, and repeated explanation of these structural elements is omitted.

Embodiments of the present invention will be described in detail below with reference to the drawings when appropriate.

First Embodiment

(1) Configuration of the Embodiment

Figure 2:
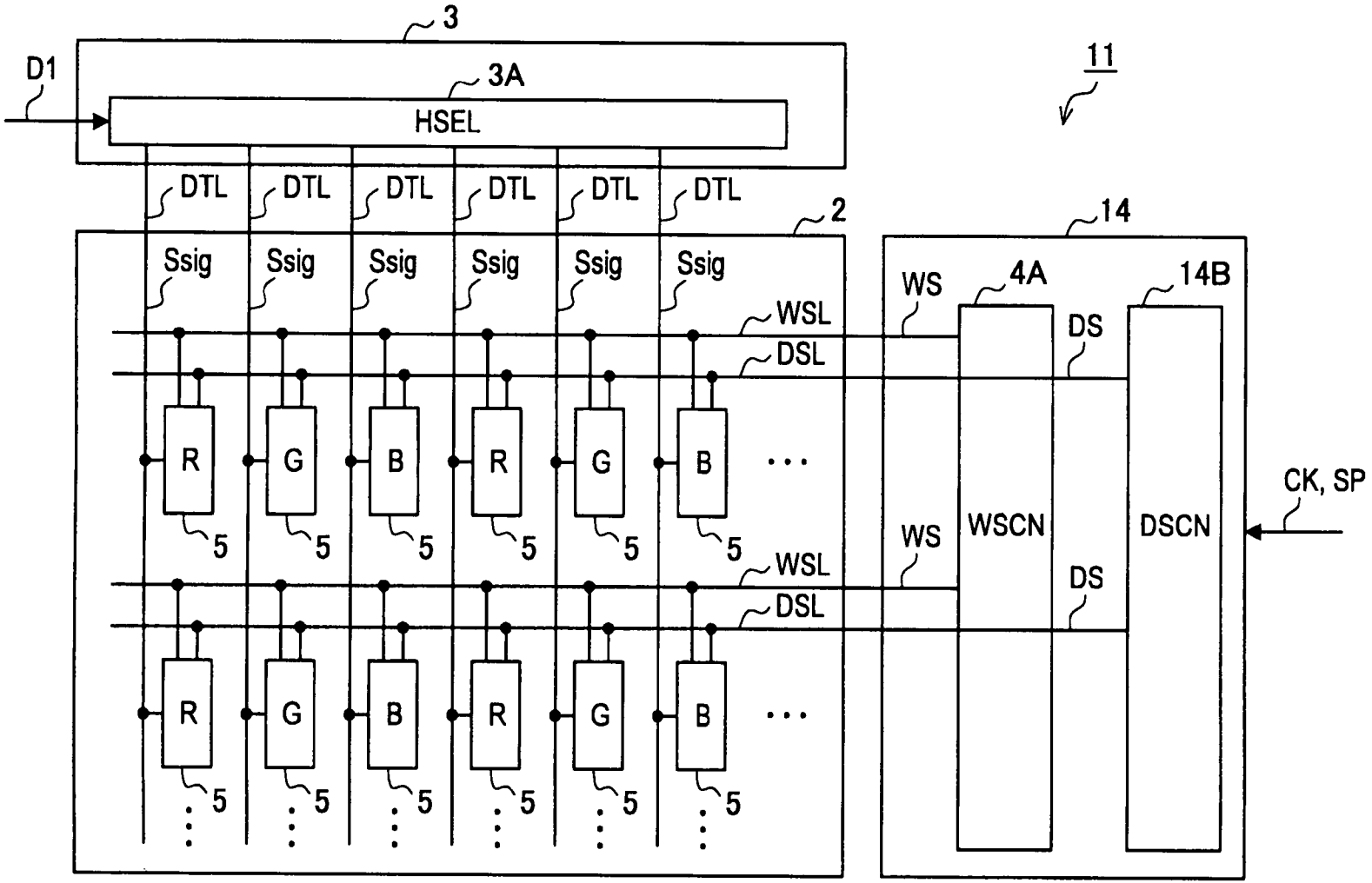
FIG. 2 is a block diagram showing the image display apparatus according to the first embodiment of the present invention.
Figure 3:
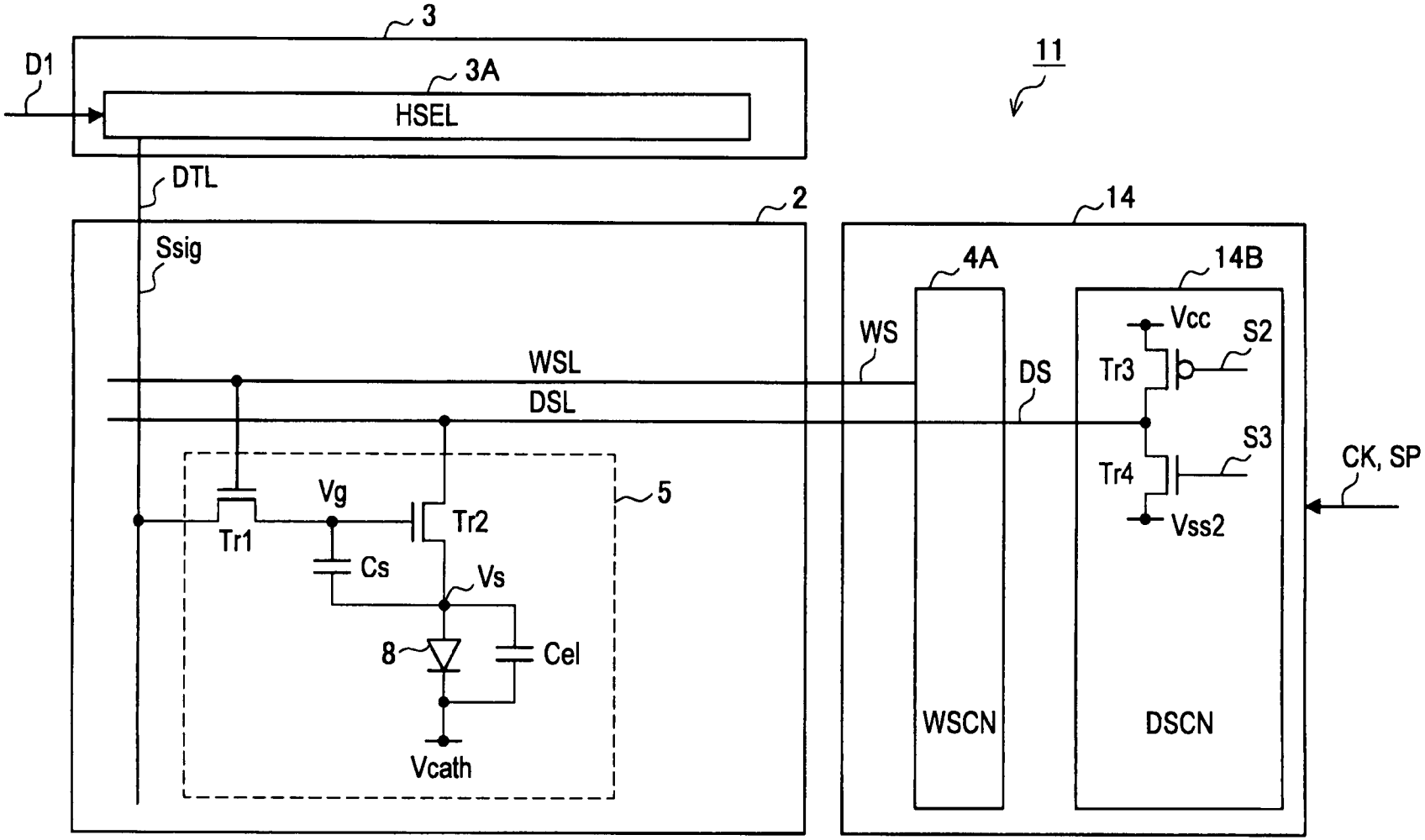
FIG. 3 is a block diagram showing the image display apparatus in FIG. 2 in detail.
Figures 4A, 4B, 4C, 4D, 4E:
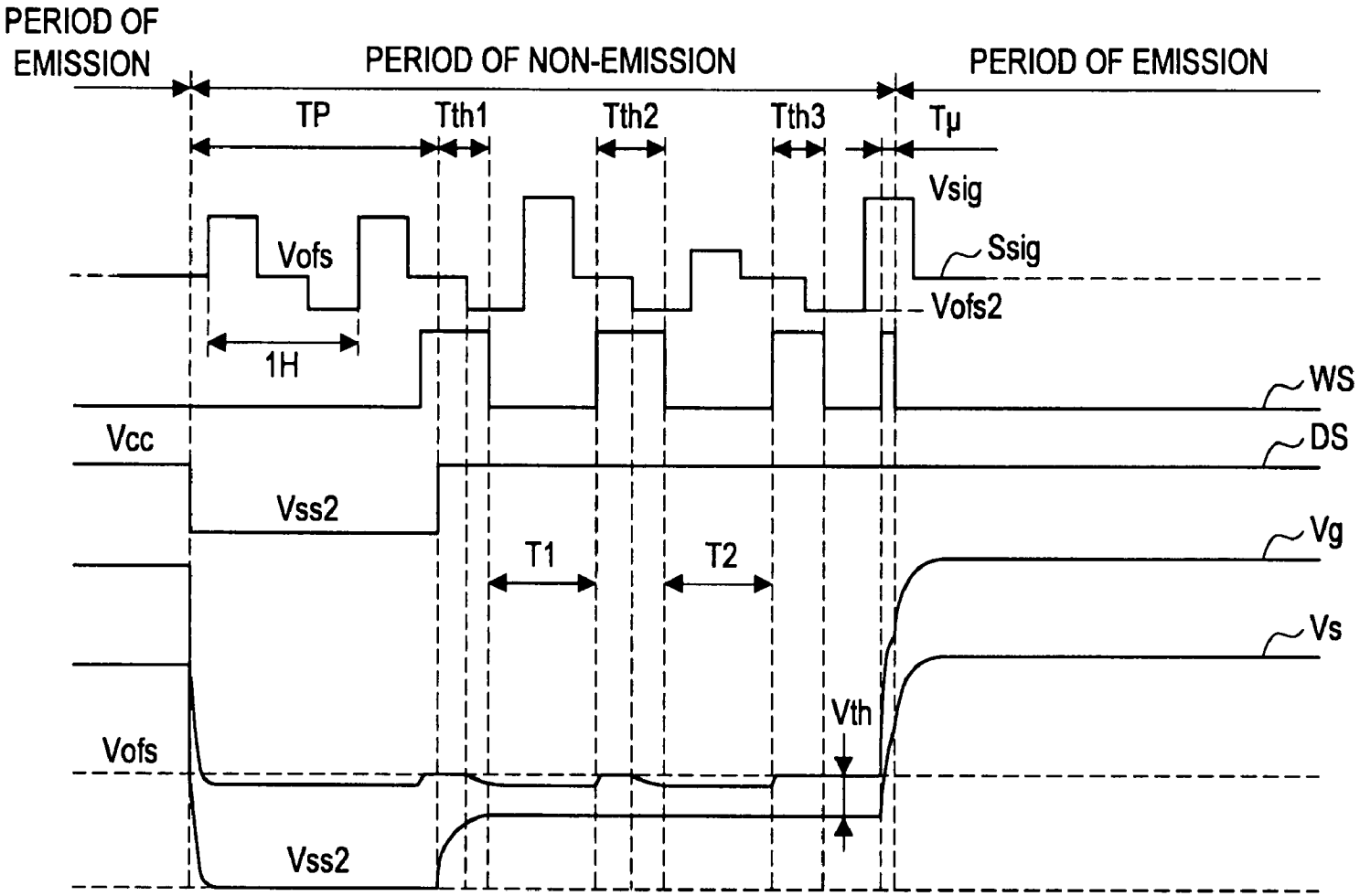
FIGS. 4A to 4E are time charts showing an operation example by voltage settings of a signal line.
Figures 5A, 5B, 5C, 5D, 5E, 5F, 5G:
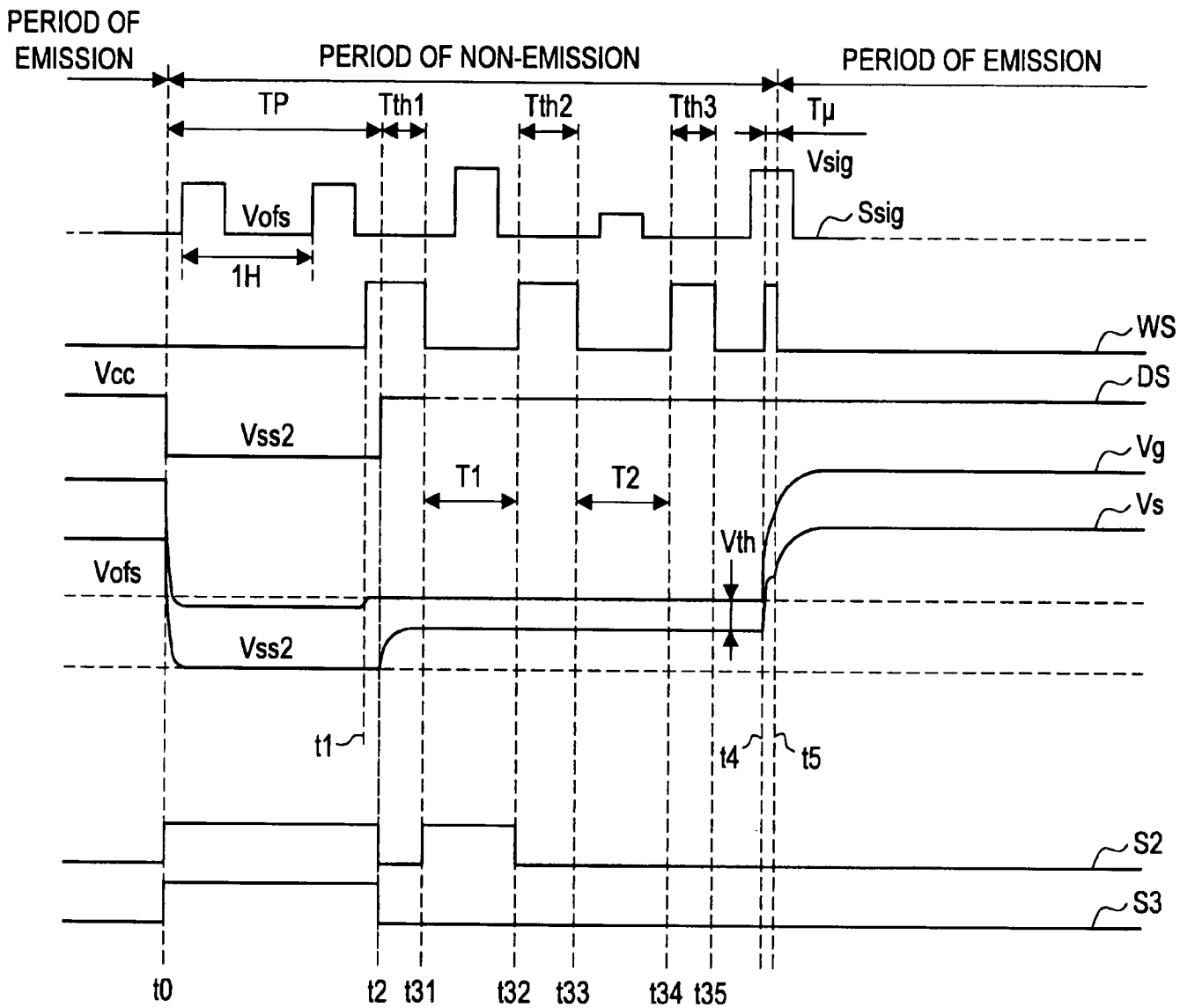
FIGS. 5A to 5G are time charts for explaining operations of an image display apparatus according to a second embodiment of the present invention.
Figures 6A, 6B, 6C, 6D, 6E, 6F, 6G:
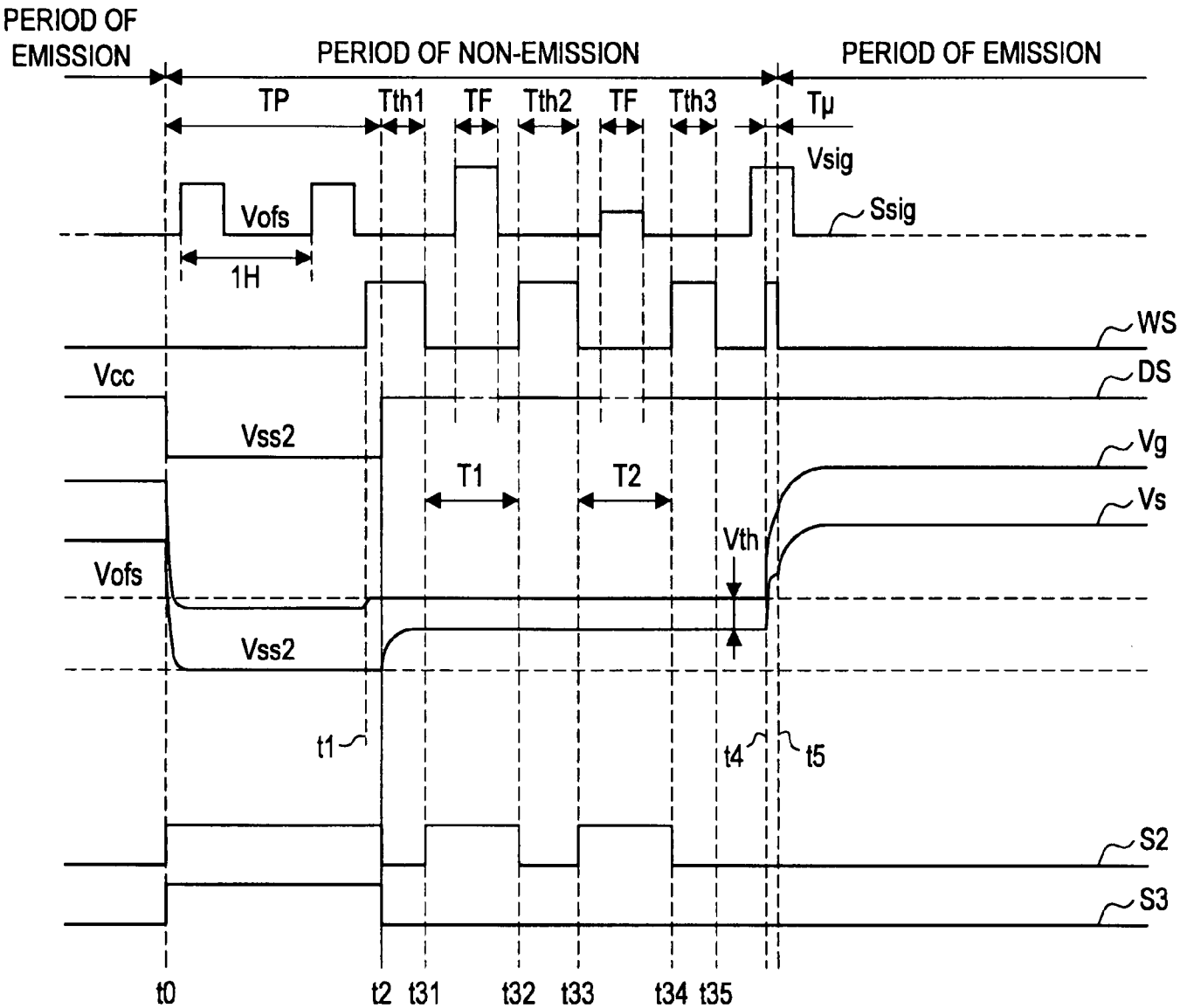
FIGS. 6A to 6G are time charts for explaining operations of an image display apparatus according to a third embodiment of the present invention.
Figures 7A, 7B, 7C, 7D, 7E, 7F, 7G:
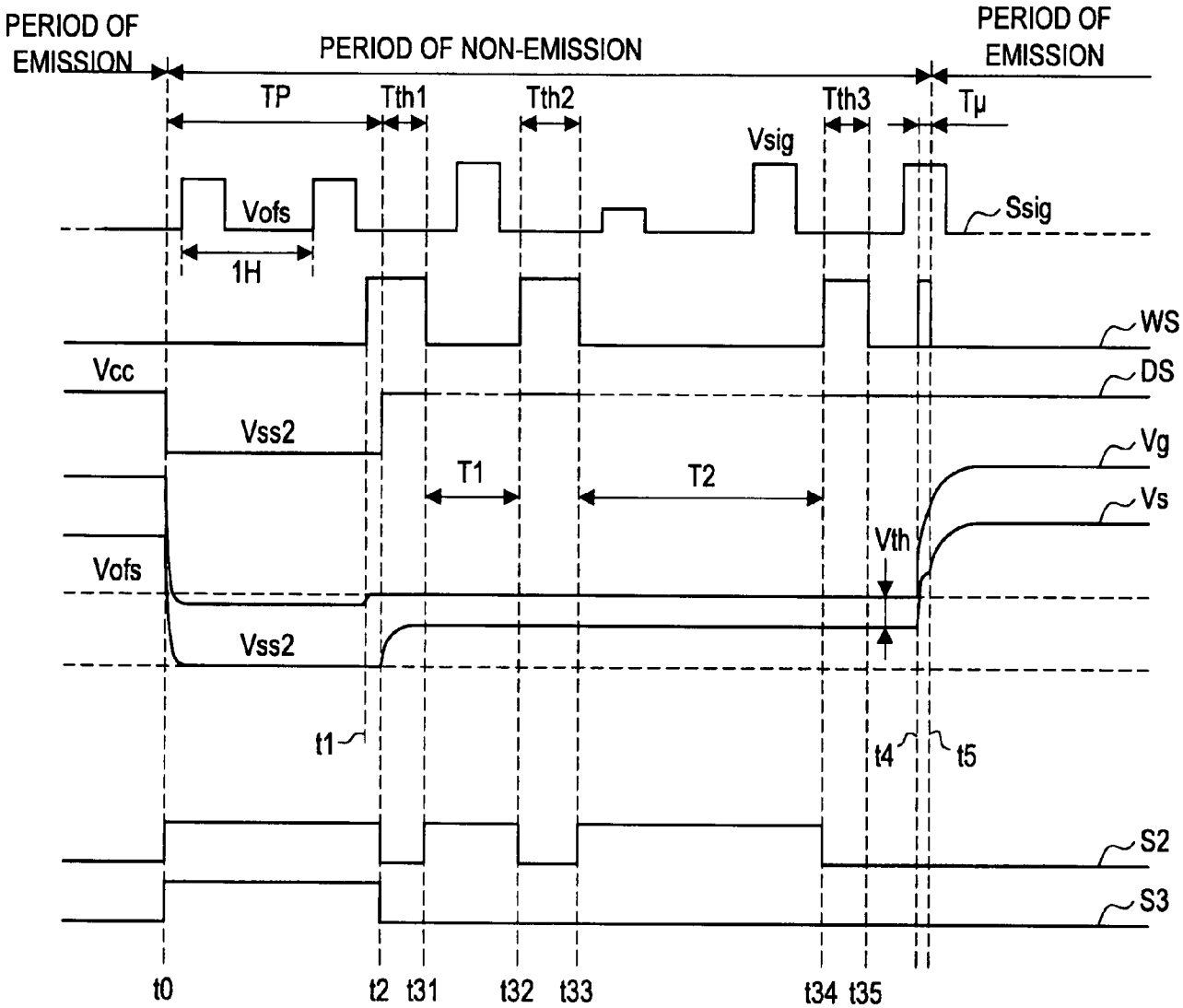
FIGS. 7A to 7G are time charts for explaining operations of an image display apparatus according to a fourth embodiment of the present invention.
Figure 8:
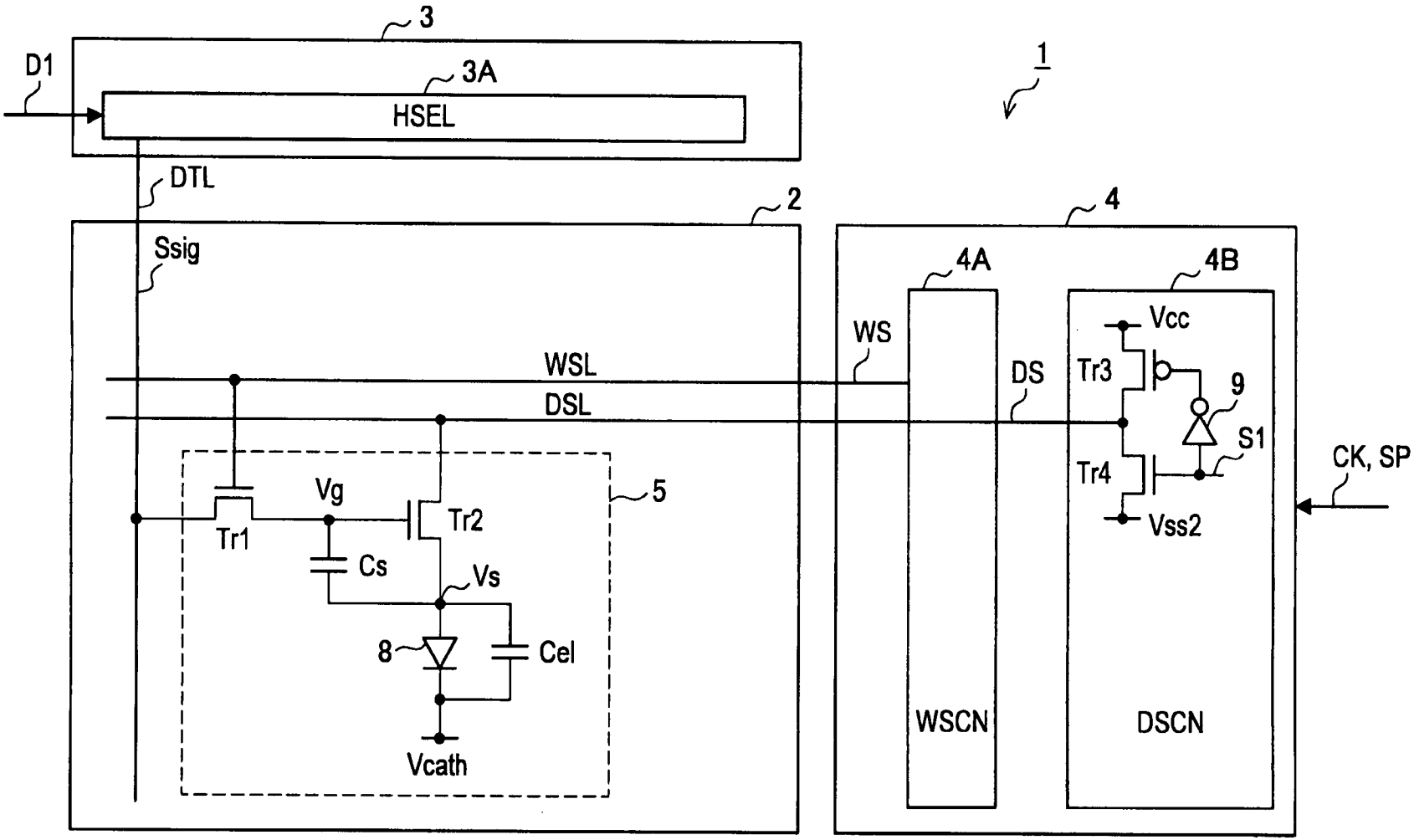
FIG. 8 is a block diagram showing an image display apparatus in related art.
Figures 9A, 9B, 9C, 9D, 9E:
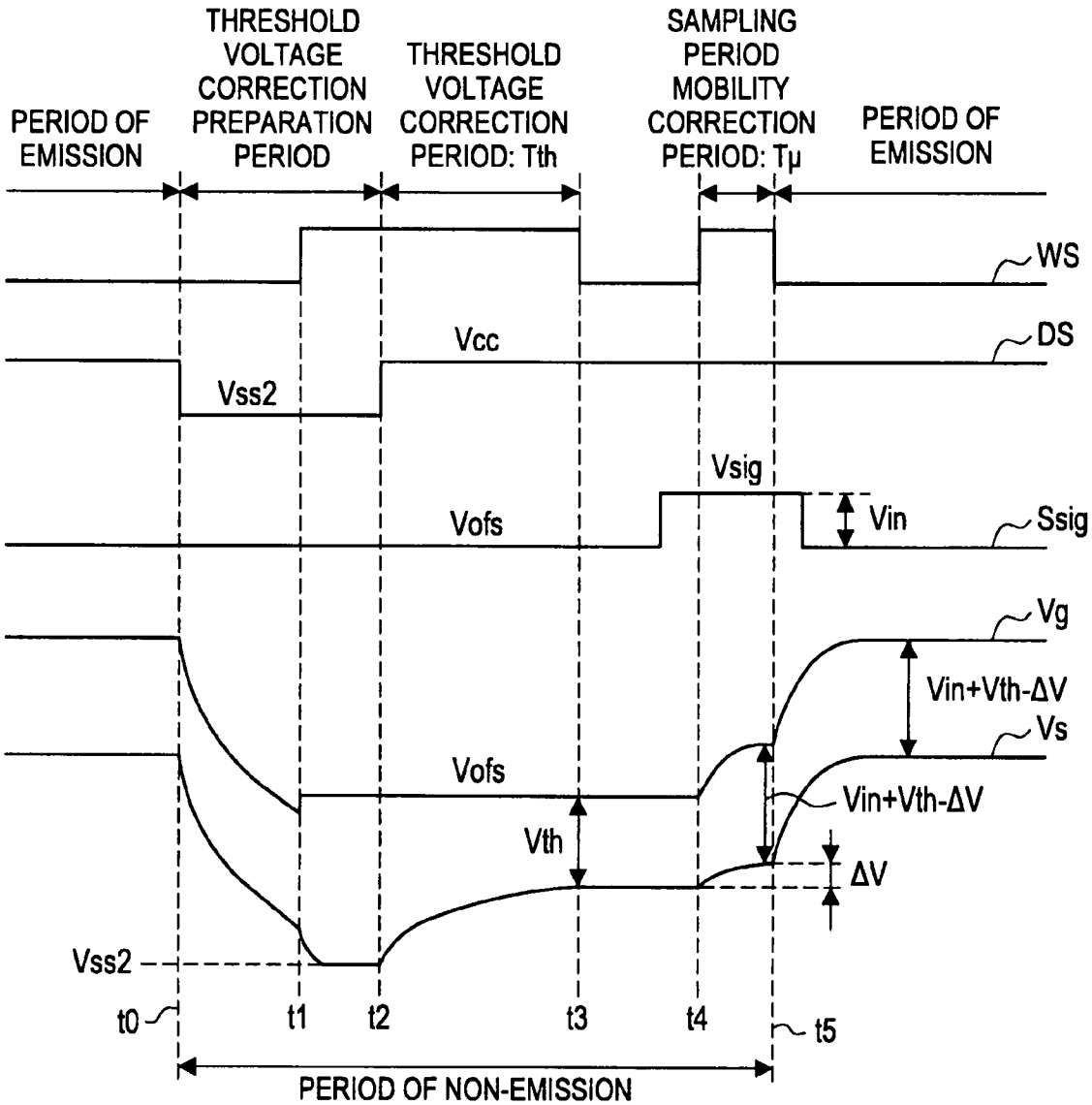
FIGS. 9A to 9E are time charts for explaining operations of the image display apparatus in FIG. 8.
Figures 10A, 10B, 10C, 10D, 10E:
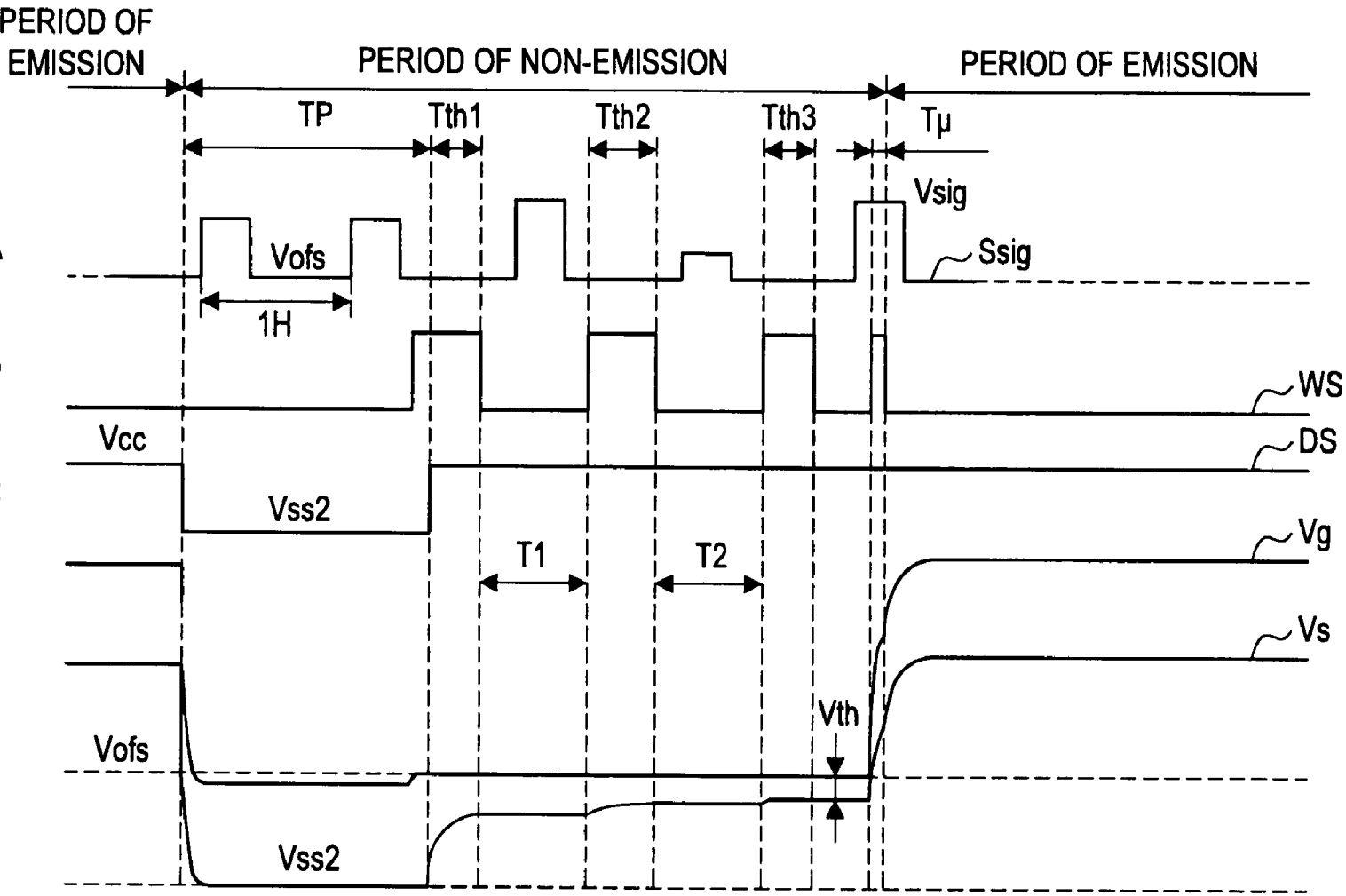
FIGS. 10A to 10E are time charts for explaining operations when pauses are provided in the image display apparatus in FIG. 8.

FIG. 2 is a block diagram showing an image display apparatus according to the first embodiment of the present invention. FIG. 3 is a block diagram showing an image display apparatus 11 in FIG. 2 by being contrasted with FIG. 8. The image display apparatus 11 is configured in the same manner as the image display apparatus described above with reference to FIG. 10 except that a scanning line driving circuit 14 is configured differently. The scanning line driving circuit 14 is configured in the same manner as that of the image display apparatus in FIG. 10 except that a drive scan circuit (DSCN) 14B is configured differently. Therefore, in the image display apparatus 11, corresponding reference numerals are attached to the same components as those of the image display apparatus described above with reference to FIG. 10 to omit a duplicate description. In FIG. 2, the pixel circuits 5 provided with red, green, and blue color filters are denoted by reference numerals R, G, and B, respectively.

Here, in the drive scan circuit 14B (FIG. 3), the P-channel type transistor Tr3 and the N-channel type transistor Tr4 whose drains are connected to the power supplies Vcc and Vss2, respectively, are provided in the output stage of the driving signal DS to each scanning line DSL. The drive scan circuit 14B is connected to, in each output stage, the corresponding scanning line DSL to which sources of the transistors Tr3 and Tr4 are connected. The transistors Tr3 and Tr4 function as switch circuits in the drive scan circuit 14B and the transistors Tr3 and Tr4 are turned on selectively to set the driving signal DS to the voltages Vcc and Vss2, respectively. The drive scan circuit 14B also sets both the transistors Tr3 and Tr4 to an OFF state to set the scanning line DSL of the driving signal DS to a floating state.

The drive scan circuit 14B processes predetermined sampling pulses SP at the clock CK to generate control signals S2 and S3 for ON/OFF control of the transistors Tr3 and Tr4, after which these control signals S2 and S3 are input into the gates of the transistors Tr3 and Tr4, respectively.

FIGS. 1A to 1G are time charts for explaining control of the transistors Tr3 and Tr4 by being contrasted with FIGS. 9A to 9E. In the pixel circuit 5, the control signals S2 and S3 are both set to the L level to retain the driving signal DS at the voltage Vcc in the period of emission (FIGS. 1C, 1F, and 1G). Accordingly, the pixel circuit 5 has the power supply Vcc supplied to the driving transistor Tr2 by the driving signal DS in the period of emission. As a result, the pixel circuit 5 drives by current the organic EL device 8 by a driving current in accordance with the gate-source voltage Vgs of the driving transistor Tr2 set for the holding capacity Cs to cause the organic EL device 8 to emit light with luminance of emission in accordance with the gate-source voltage Vgs (FIGS. 1D and 1E).

When the period of non-emission starts at time t0, the control signals S2 and S3 are both set to the H level to switch the driving signal DS to the voltage Vss2 (FIGS. 1C, 1F, and 1G). Accordingly, the drain of the driving transistor Tr2 functions as a source in the pixel circuit 5 and accumulated charges of the organic EL device 8 flow out to the scanning line DSL via the driving transistor Tr2. As a result, in the pixel circuit 5, the organic EL device 8 side of the holding capacity Cs falls to the voltage Vss2.

Subsequently, in the pixel circuit 5, the write signal WS is caused to rise at time t1 when the signal line DTL is retained at the fixed voltage Vofs for threshold voltage correction and the gate side voltage of the holding capacity Cs is thereby set to the fixed voltage Vofs for threshold voltage correction via the write transistor Tr1. Accordingly, in the pixel circuit 5, the inter-terminal voltage of the holding capacity Cs is set to a voltage equal to or higher than the threshold voltage Vth of the driving transistor Tr2 and preparation processing to correct fluctuations in threshold voltage is performed in the period between time t0 and time t2 denoted by reference numeral TP.

In the period between subsequent time t2 and time t5 when the period of non-emission ends, after the inter-terminal voltage of the holding capacity Cs is set to the threshold voltage Vth of the driving transistor Tr2, the pixel circuit 5 samples the gradation setting voltage Vsig by correcting fluctuations in mobility of the driving transistor Tr2. Moreover, the pixel circuit 5 performs processing to set the inter-terminal voltage of the holding capacity Cs to the threshold voltage Vth of the driving transistor Tr2 in a plurality of periods Tth1, Tth2, and Tth3.

That is, in the pixel circuit 5, when a predetermined time passes after the voltage of the signal line DTL is switched to the fixed voltage Vofs for threshold voltage correction, the write signal WS is caused to rise. Moreover, a fixed time before the voltage of the signal line DTL is switched to the gradation setting voltage Vsig, the write signal WS is caused to fall. Accordingly, the pixel circuit 5 causes the inter-terminal voltage of the holding capacity Cs to discharge via the driving transistor Tr2 in a partial period of a period during which the voltage of the signal line DTL is set to the fixed voltage Vofs for threshold voltage correction. The pixel circuit 5 repeats the processing in the periods Tth1, Tth2, and Tth3 to set the inter-terminal voltage of the holding capacity Cs to the threshold voltage Vth of the driving transistor Tr2.

Accordingly, in the pixel circuit 5, the control signals S2 and S3 are both set to the L level and the driving signal DS to the voltage Vcc in these periods of Tth1, Tth2, and Tth3.

In the pixel circuit 5, the control signals S2 and S3 are set to the H level and the L level, respectively, and the scanning line DSL to which the driving signal DS is output is retained in a floating state in the period T1 between the periods Tth1 and Tth2 and the period T2 between the periods Tth2 and Tth3. In a remaining period between time t35 and time t4, the control signals S2 and S3 are both set to the L level and the driving signal DS to the voltage Vcc.

Accordingly, the pixel circuit 5 retains the drain of the driving transistor Tr2 in a floating state in the entire period of the pauses T1 and T2 of threshold voltage correction processing. As a result, the pixel circuit 5 can prevent charging of the organic EL device 8 side via the driving transistor Tr2 to prevent the rise of the source voltage Vs of the driving transistor Tr2. Therefore, the drop of the gate-source voltage Vgs can be prevented in the pauses T1 and T2 and even if threshold voltage correction processing is restarted after the end of these pauses T1 and T2, the inter-terminal voltage of the holding capacity Cs can be prevented from falling below the threshold voltage Vth of the driving transistor Tr2.

(2) Operations of the Embodiment

With the above configuration, after the image data D1 input sequentially is distributed to the signal line DTL of the display unit 2 in the signal line driving circuit 3 of the image display apparatus 11 (FIG. 2, FIG. 3), digital/analog conversion processing is performed. Accordingly, in the image display apparatus 11, the gradation voltage Vin indicating the gradation of each pixel connected to the signal line DTL is created for each signal line DTL. In the image display apparatus 11, the gradation voltage Vin is set to each of the pixel circuits 5 constituting the display unit 2 according to, for example, the line sequence by the display unit 2 being driven by the scanning line driving circuit 14. The organic EL device 8 in each of the pixel circuits 5 emits light based on luminance of emission in accordance with the gradation voltage Vin (FIGS. 9A to 9E). Accordingly, in the image display apparatus 11, an image in accordance with the image data D1 can be displayed in the display unit 2.

More specifically, in the pixel circuit 5, the organic EL device 8 is driven by current by the driving transistor Tr2 in the source follower circuit configuration. In the pixel circuit 5, the voltage on the gate side of the holding capacity Cs provided between the gate and source of the driving transistor Tr2 is set to the voltage Vsig in accordance with the gradation voltage Vin. Accordingly, in the image display apparatus 11, a desired image is displayed by causing the organic EL device 8 to emit light based on luminance of emission in accordance with the image data D1.

However, the driving transistor Tr2 applied to the pixel circuit 5 has a disadvantage that fluctuations in the threshold voltage Vth are great. As a result, if the voltage on the gate side of the holding capacity Cs is simply set to the voltage Vsig in accordance with the gradation voltage Vin in the image display apparatus 11, the luminance of emission of the organic EL device 8 fluctuates because the threshold voltage Vth of the driving transistor Tr2 fluctuates, which leads to deterioration of image quality.

Thus, in the image display apparatus 11, after the voltage on the side of the organic EL device 8 of the holding capacity Cs is caused to fall, the gate voltage of the driving transistor Tr2 is set to the fixed voltage Vofs for threshold voltage correction via the write transistor Tr1 by causing the driving signal Ds to fall to the voltage Vss2 enough to cause the source of the driving transistor Tr2 to function as a drain. Accordingly, in the image display apparatus 11, the inter-terminal voltage of the holding capacity Cs is set to the threshold voltage Vth of the driving transistor Tr2 or higher. Then, the driving signal DS is caused to rise to the voltage Vcc and, as a result, the inter-terminal voltage of the holding capacity Cs is caused to discharge via the driving transistor Tr2. With the sequence of processing, the inter-terminal voltage of the holding capacity Cs is set to the threshold voltage Vth of the driving transistor Tr2 in advance in the image display apparatus 11.

Then, in the image display apparatus 11, the gradation setting voltage Vsig obtained by adding the fixed voltage Vofs to the gradation voltage Vin is set to the gate voltage of the driving transistor Tr2. Accordingly, in the image display apparatus 11, image quality deterioration due to fluctuations in the threshold voltage Vth of the driving transistor Tr2 can be prevented.

Image quality deterioration due to fluctuations in mobility of the driving transistor Tr2 can be prevented by retaining the gate voltage of the driving transistor Tr2 at the gradation setting voltage Vsig while power is supplied to the driving transistor Tr2 for a fixed period Tμ.

However, if the inter-terminal voltage of the holding capacity Cs is set to the threshold voltage Vth of the driving transistor Tr2 by a discharge via the driving transistor Tr2 after setting the inter-terminal voltage of the holding capacity Cs to a voltage equal to or higher than the threshold voltage Vth of the driving transistor Tr2 in this manner, it becomes more difficult to allocate a sufficient time to a discharge of the inter-terminal voltage of the holding capacity Cs due to higher resolutions or frequencies.

Thus, in the present embodiment (FIGS. 1A to 1G), the inter-terminal voltage of the holding capacity Cs is caused to discharge in the plurality of periods Tth1, Tth2, and Tth3, thereby enabling allocation of a sufficient time to a discharge of the inter-terminal voltage even after higher resolutions or higher frequencies are applied, so that image quality deterioration due to fluctuations in threshold voltage can be prevented.

However, if the inter-terminal voltage of the holding capacity Cs is caused to discharge in the plurality of periods Tth1, Tth2, and Tth3 in this manner, a current obtained by subtracting the threshold voltage Vth of the driving transistor Tr2 from the inter-terminal voltage of the holding capacity Cs flows in the driving transistor Tr2 in the pauses T1 and T2 of threshold voltage correction processing between the plurality of periods. In the pixel circuit 5, the organic EL device 8 is charged by the current and the source voltage Vs of the driving transistor Tr2 gradually rises, lowering the inter-terminal voltage of the holding capacity Cs.

If the inter-terminal voltage of the holding capacity Cs is sufficiently close to the threshold voltage Vth of the driving transistor Tr2, the drop of the inter-terminal voltage can safely be ignored. However, if the inter-terminal voltage of the holding capacity Cs is not sufficiently close to the threshold voltage Vth of the driving transistor Tr2, it is difficult for the pixel circuit 5 to ignore the drop of the inter-terminal voltage and if threshold voltage correction processing is subsequently restarted, the inter-terminal voltage of the holding capacity Cs will drop below the threshold voltage Vth of the driving transistor Tr2. In this case, it becomes difficult for the pixel circuit 5 to correct fluctuations in threshold voltage of the driving transistor Tr2, leading to deterioration of image quality.

Thus, in the present embodiment, the scanning line DSL to which the driving signal DS is output is retained in a floating state in the entire period of the pauses T1 and T2 of threshold voltage correction processing. As a result, in the pixel circuit 5, even if the inter-terminal voltage of the holding capacity Cs is not sufficiently close to the threshold voltage Vth of the driving transistor Tr2, charging of the organic EL device 8 by the driving transistor Tr2 can be prevented during the pauses of T1 and T2. As a result, the drop of the inter-terminal voltage of the holding capacity Cs can be prevented during the pauses of T1 and T2 so that fluctuations in threshold voltage of the driving transistor Tr2 can correctly be corrected.

Incidentally, as shown in FIGS. 4A to 4E by being contrasted with FIGS. 1A to 1G, a failure of threshold voltage correction processing can similarly be prevented by causing the voltage of the signal line DTL to fall to a fixed voltage Vofs2 lower than the fixed voltage Vofs immediately before the end of the period Tth1 or Tth2. That is, in this case, the inter-terminal voltage of the holding capacity Cs is forcibly set to a voltage equal to or lower than the threshold voltage Vth of the driving transistor Tr2 during the pauses T1 and T2 by causing the voltage of the signal line DTL to fall to the fixed voltage Vofs2. If the terminal voltage of the holding capacity Cs is set to the fixed voltage Vofs via the write transistor Tr1 when the pause T1 or T2 ends, the inter-terminal voltage of the holding capacity returns to the voltage immediately before the voltage of the signal line DTL is caused to fall to the fixed voltage Vofs2. Accordingly, in the example in FIGS. 4A to 4E, fluctuations in threshold voltage of the driving transistor can reliably be corrected even if the inter-terminal voltage is discharged in a plurality of periods.

However, this method has a disadvantage that a time of several μsec is necessary to lower the inter-terminal voltage of the holding capacity Cs with the fixed voltage Vofs2 so that it is difficult to adequately support higher resolutions or frequencies. Moreover, this method has a disadvantage that the configuration of the signal line driving circuit becomes more complex and power consumption increases.

According to the present embodiment, by contrast, with a simple configuration of simply changing control of the output stage in the drive scan circuit 14B, deterioration of image quality can be prevented by adequately supporting higher resolutions or frequencies. Therefore, the configuration of modules constituting a vertical driving circuit can be made simpler and further, the image display apparatus 11 can be made a narrower frame.

(3) Effects of the Embodiment

According to the above configuration, fluctuations in threshold voltage of a driving transistor can reliably be corrected by setting the scanning line to which a driving signal for power supply is output to a floating state in the entire period of pauses of threshold voltage correction processing even if fluctuations in threshold voltage of the driving transistor are corrected by discharging the inter-terminal voltage of holding capacity via the driving transistor in a plurality of periods.

Deterioration of image quality can effectively be avoided by applying the above configuration to a case in which a pixel circuit is constituted by two transistors by setting the inter-terminal voltage of holding capacity to a voltage equal to or higher than the threshold voltage of the driving transistor by causing the driving signal to fall.

Second Embodiment

FIGS. 5A to 5G are time charts for explaining an image display apparatus in the second embodiment of the present invention by being contrasted with FIGS. 1A to 1G. The image display apparatus in the present embodiment sets the scanning line DSL to a floating state only in the pause T1, which is a partial period of the pauses T1 and T2 and the first period.

That is, the rise of the source voltage Vs of the driving transistor Tr2 in a pause increases with an increasing inter-terminal voltage of the holding capacity Cs with respect to the threshold voltage Vth of the driving transistor Tr2. Therefore, the rise of the source voltage Vs becomes the largest in the first pause among a plurality of pauses and threshold voltage correction processing will fail in a pause subsequent to the first pause.

Moreover, the rise of the source voltage Vs can be ignored in other pauses than the first one because the inter-terminal voltage of holding capacity is adequately close to the threshold voltage Vth of the driving transistor Tr2.

Accordingly, in the present embodiment, the scanning line DSL is set to a floating state only in the first pause T1 and the driving signal DS is retained at the voltage Vcc in the remaining pauses.

In the present embodiment, control according to the scanning line is simplified by setting the scanning line to a floating state only in the first pause to be able to achieve the same effect as that in the first embodiment.

Third Embodiment

FIGS. 6A to 6G are time charts for explaining an image display apparatus in the third embodiment of the present invention by being contrasted with FIGS. 1A to 1G. The image display apparatus in the present embodiment sets the scanning line DSL to a floating state only in periods TF, which are a partial period of the pauses T1 and T2 and during which the signal line DTL is set to the gradation setting voltage Vsig.

That is, even when a charging current of the driving transistor Tr2 is large, the rise of the source voltage Vs due to the charging current of the driving transistor Tr2 can safely be ignored if the period of charging the organic EL device 8 is short. Accordingly, in the present embodiment, a failure of threshold voltage correction processing is prevented by setting the scanning line DSL to a floating state only in the periods TF during which the signal line DTL is set to the gradation setting voltage Vsig of the pauses T1 and T2.

According to the present embodiment, the same effect as that in the first or second embodiment can be achieved by setting the scanning line to a floating state only in periods which are a partial period of pauses and during which the signal line is set to the gradation setting voltage.

Fourth Embodiment

FIGS. 7A to 7G are time charts for explaining an image display apparatus in the fourth embodiment of the present invention by being contrasted with FIGS. 1A to 1G. In the image display apparatus in the present embodiment, pauses are set for a period equal to or longer than one horizontal scanning period (1H). Therefore, in the example in FIGS. 7A to 7G, the second pause T2 is set to a period including two periods during which the signal level of the signal line DTL is set to the gradation setting voltage Vsig. In the present embodiment, the scanning line is set to a floating state during the pauses T1 and T2.

The same effect as that of the above embodiments can be achieved even if, like the present embodiment, a pause is set to a period equal to or longer than one horizontal scanning period.

In the above embodiments, cases in which the scanning line is set to a floating state in the entire period of a pause or in a period of a pause during which the voltage of a signal line is retained at the gradation setting voltage have been described, but the present invention is not limited to such cases. The configuration of each of the above embodiments may be combined or further, the scanning line may be set to a floating state in a period that is equal to or shorter than a pause and also equal to or longer than a period during which the voltage of a signal line is retained at the gradation setting voltage. Alternatively, the scanning line may be set to a floating state in a period longer than a pause so that the pause is included.

Also in the above embodiments, cases have been described in which the voltage on the side of an organic EL device of holding capacity is caused to fall by causing the driving signal DS for power supply to fall to the voltage Vss2 to set the inter-terminal voltage of holding capacity to a voltage equal to or higher than the threshold voltage of the driving transistor Tr2. However, the present invention is not limited to such cases and may be widely applied to a case in which, for example, a transistor is separately provided and the voltage on the side of the organic EL device of holding capacity is caused to fall by ON/OFF control of the transistor.

Also in the above embodiments, cases in which an N-channel type transistor is applied as a driving transistor have been described, but the present invention is not limited to such cases and may be widely applied to an image display apparatus or the like in which P-channel type transistors are applied as driving transistors.

Also in the above embodiments, cases in which the present invention is applied to an image display apparatus of organic EL devices have been described, but the present invention is not limited to such cases and may be widely applied to image display apparatuses of various current-driven self-luminous devices.

It should be understood by those skilled in the art that various modifications, combinations, sub-combinations and alterations may occur depending on design requirements and other factors insofar as they are within the scope of the appended claims or the equivalents thereof.

The present application contains subject matter related to that disclosed in Japanese Priority Patent Application JP 2008-277898 filed in the Japan Patent Office on 29 Oct. 2008, the entire content of which is hereby incorporated by reference.

The present invention relates to an image display apparatus and a method of driving the image display apparatus and can be applied to, for example, an active matrix image display apparatus using organic EL devices.

What is claimed is:

1. An image display apparatus comprising:

a display unit in which pixel circuits are arranged in a matrix form;

a signal line driving circuit configured to output a signal line driving signal to a signal line provided in the display unit; and a scanning line driving circuit configured to output at least a driving signal for power supply and a write signal to a scanning line provided in the display unit, wherein the pixel circuit includes at least:

a light-emitting device;

a driving transistor, a drain thereof being configured to receive the driving signal for power supply to drive the light-emitting device by a driving current in accordance with a gate-source voltage;

a holding capacitor configured to hold the gate-source voltage; and a write transistor configured to connect a gate of the driving transistor to the signal line by the write signal to set a terminal voltage of the holding capacitor to a voltage of the signal line, and wherein:

the light-emitting device is configured to alternately repeat a period of emission and a period of non-emission during which light emission by the light-emitting device is stopped by output signals of the signal line driving circuit and the scanning line driving circuit, the pixel circuit, in the period of non-emission and after an inter-terminal voltage of the holding capacitor is set to a voltage equal to or higher than a threshold voltage of the driving transistor, the driving transistor is configured to supply the inter-terminal voltage of the holding capacitor in a plurality of periods sandwiching a pause therebetween to set the inter-terminal voltage of the holding capacitor to the threshold voltage of the driving transistor and then, the write transistor is configured to the terminal voltage of the holding capacitor to set a gradation of the light-emitting device in a subsequent period of emission, and the scanning line driving circuit is configured to set the scanning line, to which the driving signal for power supply is output, to a floating state in an entire period of the pauses or a partial period thereof.

2. The image display apparatus according to claim 1, wherein a plurality of the corresponding pauses is provided for one gradation setting of the light-emitting device, and the partial period is a first period of the plurality of pauses.

3. The image display apparatus according to claim 1, wherein the scanning line driving circuit causes the voltage of the driving signal for power supply to fall to a voltage equal to or lower than a voltage on a side opposite to the driving transistor of the light-emitting device in the period of non-emission, and the pixel circuit causes the voltage on the side of the light-emitting device of the holding capacitor to fall with the fall of the voltage of the driving signal for power supply to set the inter-terminal voltage of the holding capacitor to a voltage equal to or higher than the threshold voltage of the driving transistor.

4. A method of driving an image display apparatus comprising a display unit in which pixel circuits are arranged in a matrix form, a signal line driving circuit that outputs a signal line driving signal to a signal line provided in the display unit; and a scanning line driving circuit that outputs at least a driving signal for power supply and a write signal to a scanning line provided in the display unit, wherein the pixel circuit includes at least a light-emitting device; a driving transistor, to a drain of which the driving signal for power supply is applied to drive by current the light-emitting device by a driving current in accordance with a gate-source voltage a holding capacitor that holds the gate-source voltage; and a write transistor that connects a gate of the driving transistor to the signal line by the write signal to set a terminal voltage of the holding capacitor to a voltage of the signal line, and the driving method comprising:

alternately repeating a period of emission during which the light-emitting device is caused to emit light and a period of non-emission during which light emission by the light-emitting device is stopped by output signals of the signal line driving circuit and the scanning line driving circuit, setting an inter-terminal voltage of the holding capacitor to a voltage equal to or higher than a threshold voltage of the driving transistor in the period of non-emission;

discharging the inter-terminal voltage of the holding capacitor via the driving transistor in a plurality of periods sandwiching a pause therebetween to set the inter-terminal voltage of the holding capacitor to the threshold voltage of the driving transistor in the period of non-emission; and setting the terminal voltage of the holding capacitor via the write transistor to set a gradation of the light-emitting device in a subsequent period of emission in the period of non-emission, and setting the scanning line to which the driving signal for power supply is output to a floating state in an entire period of the pauses or a partial period thereof.

* * * * *